US009685128B2

(12) United States Patent
Moon

(10) Patent No.: US 9,685,128 B2
(45) Date of Patent: Jun. 20, 2017

(54) DISPLAY APPARATUS AND METHOD OF DRIVING THE DISPLAY APPARATUS

(71) Applicant: Samsung Display Co., LTD., Yongin, Gyeonggi-Do (KR)

(72) Inventor: Kyung-Hwan Moon, Seoul (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 94 days.

(21) Appl. No.: 14/642,338

(22) Filed: Mar. 9, 2015

(65) Prior Publication Data

US 2016/0055819 A1 Feb. 25, 2016

(30) Foreign Application Priority Data

Aug. 19, 2014 (KR) ..... 10-2014-0107815

(51) Int. Cl.
*G09G 3/36* (2006.01)

(52) U.S. Cl.
CPC ... *G09G 3/3648* (2013.01); *G09G 2320/0285* (2013.01); *G09G 2330/026* (2013.01); *G09G 2370/08* (2013.01)

(58) Field of Classification Search
CPC ..... G09G 2320/0285; G09G 2330/026; G09G 3/3648; G09G 2370/08
See application file for complete search history.

(56) References Cited

U.S. PATENT DOCUMENTS

2001/0022568 A1* 9/2001 Kang ..... G09G 3/006 345/87
2003/0030551 A1* 2/2003 Ho ..... B60R 1/00 340/435
2009/0146935 A1* 6/2009 Song ..... G09G 3/3611 345/87
2010/0085988 A1* 4/2010 Fukuda ..... H04L 25/02 370/480
2013/0216235 A1 8/2013 Ishida et al.
2014/0267316 A1* 9/2014 Connell ..... G06T 1/20 345/503
2016/0132280 A1* 5/2016 Tomonaga ..... G06F 3/1438 345/502

FOREIGN PATENT DOCUMENTS

KR 1020060035590 A 4/2006
KR 1020060035591 A 4/2006
KR 1020130061225 A 6/2013
KR 1020130099830 A 9/2013

* cited by examiner

*Primary Examiner* — Abbas Abdulselam
(74) *Attorney, Agent, or Firm* — Robert E. Bushnell, Esq.

(57) ABSTRACT

A display apparatus includes a set control circuit configured to generate a plurality of transmission signals and transmitting the transmission signals through a transmitting interface, a display control circuit configured to receive the transmission signals through a receiving interface and to drive a display panel based on the transmission signals, and a transmission channel connecting the transmitting interface and the receiving interface, and configured to transfer the transmission signals. The display control circuit is configured to transmit and receive a transmission signal with the set control circuit through the transmission channel, and to control the set control circuit to determine a signal level of the transmission signal into an optimal signal level being a receivable signal level for the display control circuit.

19 Claims, 5 Drawing Sheets

DISPLAY APPARATUS AND METHOD OF DRIVING THE DISPLAY APPARATUS

CLAIM OF PRIORITY

This application claims priority from and all the benefits under 35 U.S.C. §119 of Korean Patent Application No. 10-2014-0107815, filed on Aug. 19, 2014 in the Korean Intellectual Property Office, which is hereby incorporated by reference for all purposes as if fully set forth herein.

BACKGROUND OF THE INVENTION

Field of the Invention

Embodiments of the present invention relate to a display apparatus and a method of driving the display apparatus. More particularly, embodiments of the present invention relate to a display apparatus for decreasing power consumption and a method of driving the display apparatus.

Description of the Related Art

A liquid crystal display ("LCD") panel may include a thin film transistor ("TFT") substrate, an opposing substrate and an LC layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

A driver circuit of the LCD panel receives a source voltage, a data signal and a command signal through an interface. The driver circuit generates a driving voltage for driving the LCD panel using the source voltage. The driver circuit displays an image on the display panel based on the data signal and the command signal.

SUMMARY OF THE INVENTION

Exemplary embodiments of the inventive concept provide a display apparatus for decreasing power consumption.

Exemplary embodiments of the inventive concept provide a method of driving the display apparatus.

According to an exemplary embodiment of the inventive concept, there is provided a display apparatus. The display apparatus includes a set control circuit configured to generate a plurality of transmission signals and transmitting the transmission signals through a transmitting interface, a display control circuit configured to receive the transmission signals through a receiving interface and to drive a display panel based on the transmission signals, and a transmission channel connecting the transmitting interface and the receiving interface, and configured to transfer the transmission signals. The display control circuit may be configured to transmit and receive a transmission signal with the set control circuit through the transmission channel, and to control the set control circuit to determine a signal level of the transmission signal into an optimal signal level being a receivable signal level for the display control circuit.

In an exemplary embodiment, the display control circuit may include a look up table which comprises a plurality of offset levels for adjusting the signal level of the transmission signal.

In an exemplary embodiment, the transmission signals may include comprise a low-power signal and a high-speed signal.

In an exemplary embodiment, the look up table may include comprises a plurality of low offset levels corresponding the low-power signal and a plurality of high offset levels corresponding to the high-speed signal.

In an exemplary embodiment, the low-power signal may include comprises a clock signal and a command signal, and the high-speed signal comprises a data signal.

In an exemplary embodiment, the display control circuit may be configured to adjust a signal level of at least one of the low-power signal and the high-speed signal.

In an exemplary embodiment, the transmitting and receiving interfaces may include a Mobile Industry Processor Interface ("MIPI") mode.

In an exemplary embodiment, the display control circuit may be configured to gradually adjust the signal level of the transmission signal using the offset levels according to whether the transmission signal transmitted from the set control circuit is normal, during an initial driving period.

In an exemplary embodiment, the transmission channel may include a printed circuit board on which the set control circuit is disposed, a flexible circuit board is connected to the display control circuit and a connector connecting the printed circuit board and the flexible circuit board.

In an exemplary embodiment, the display control circuit may be disposed in a peripheral area of the display panel, and may include a timing controller configured to control a driving timing of the display panel and a data driver circuit configured to drive a data line of the display panel.

In an exemplary embodiment, the set control circuit may include a battery.

According to an exemplary embodiment of the inventive concept, there is provided a method of driving a display apparatus. The method includes transmitting a plurality of transmission signals through a transmitting interface of a set control circuit, receiving the transmission signals through a receiving interface of a display control circuit, driving a display panel based on received transmission signals, and transmitting and receiving a transmission signal through a transmission channel to determine a signal level of the transmission signal into an optimal signal level being a receivable signal level for the display control circuit, during an initial driving period.

In an exemplary embodiment, the method may further include adjusting the signal level of the transmission signal using a plurality of offset levels in stored a look up table.

In an exemplary embodiment, the plurality of transmission signals may include a low-power signal and a high-speed signal.

In an exemplary embodiment, the look up table may include a plurality of low offset levels corresponding to the low-power signal and a plurality of high offset levels corresponding to the high-speed signal.

In an exemplary embodiment, a signal level of one of the low-power signal and the high-speed signal may be adjusted using the look up table.

In an exemplary embodiment, the transmitting and receiving interfaces may include a Mobile Industry Processor Interface mode.

In an exemplary embodiment, the signal level of the transmission signal may be gradually adjusted using the plurality of offset levels according to whether the transmission signal received from the set control circuit is normal during an initial driving period.

In an exemplary embodiment, the method may further include transmitting the transmission signal of the optimal signal level to the display control circuit for driving a display panel.

According to the inventive concept, the signal level of the transmission signal transmitted between the set control circuit and the display control circuit may be adjusted according to the channel environment of the transmission channel physically connecting the set control circuit and the display control circuit and thus, unnecessary level margin of the transmission signal may be decreased. Therefore, power consumption of the display apparatus may be decreased.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the inventive concept will be explained in detail with reference to the accompanying drawings.

Figure 1:
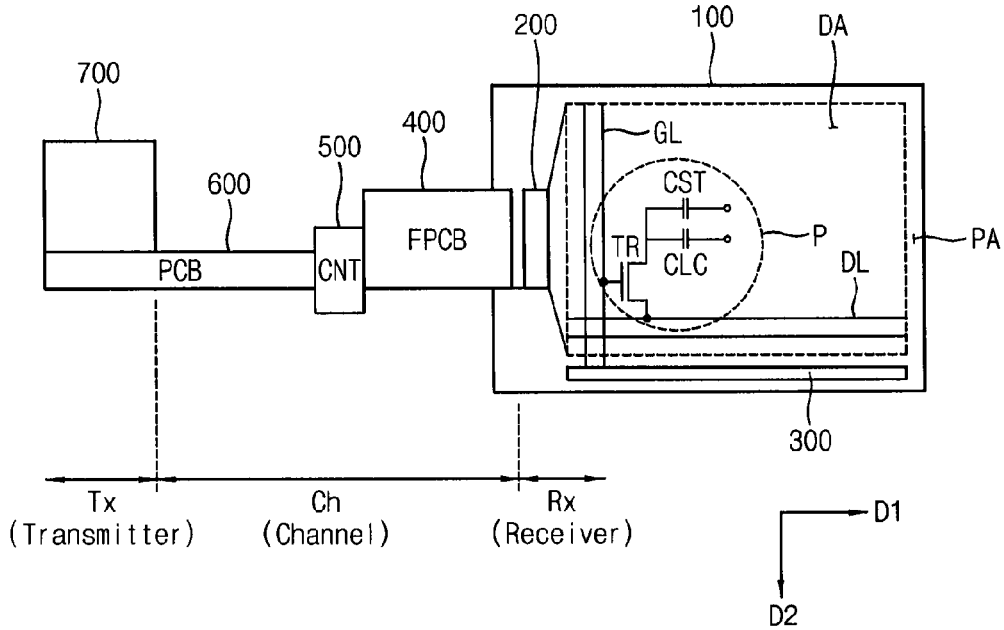
FIG. 1 is a conceptual diagram illustrating a display apparatus according to an exemplary embodiment.

FIG. 1 is a conceptual diagram illustrating a display apparatus according to an exemplary embodiment.

Referring to FIG. 1, the display apparatus may include a display panel 100, a display control circuit 200, a gate driving circuit 300, a flexible circuit board 400, a connector 500, a printed circuit board 600 and a set control circuit 700.

The display panel 100 may be divided into a display area DA and a peripheral area PA surrounding the display area DA. A plurality of gate lines, a plurality of data lines and a plurality of pixels are disposed in the display area DA. The data lines DL extend in a first direction D1 and are arranged in a second direction D2 crossing the first direction D1. The gate lines GL extend in the second direction D2 and are arranged in the first direction D1. The pixels P are arranged in a matrix array. Each of the pixels P include a switching element TR which is electrically connected to a gate line GL and a data line DL, a liquid crystal capacitor CLC which is electrically connected to the switching element TR and a storage capacitor CST which is electrically connected to the liquid crystal capacitor CLC.

The display control circuit 200 may be disposed on the peripheral area PA of the display panel 100. The display control circuit 200 generally controls driving timing of the display panel 100 in order that an image displays on the pixels P of display panel 100. In addition, the display control circuit 200 may include a data driver circuit which is configured to output a data voltage to a data line DL.

The gate driving circuit 300 is disposed on the peripheral area PA of the display panel 100. The gate driving circuit 300 is configured to output a gate signal to a gate line GL. The gate driving circuit 300 may be disposed on the peripheral area PA such as a chip type. Alternatively, the gate driving circuit 300 may be directly integrated on the peripheral area PA via the process substantially same as that forming the switching element TR.

The flexible circuit board 400 includes a first end portion which is electrically connected to the peripheral area PA of the display panel 100 and is configured to transfer a plurality of transmission signals to the display control circuit 200. The plurality of transmission signals may includes a plurality of data signals, a plurality of synchronization signals, a power source signals and so on.

According to an exemplary embodiment, the transmission signals may include a level control signal for adaptively adjusting a signal level of a transmission signal according to a channel environment of a transmission channel between the set control circuit 700 and the display control circuit 200.

For example, the data signals, the synchronization signals and the power source signal may be a transmission signal which is transferred between the set control circuit 700 and the display control circuit 200. The level control signal may be a transmission signal which is transmitted from the display control circuit 200 to the set control circuit 700.

The connector 500 connects a second end portion of the flexible circuit board 400 and a first end portion of the printed circuit board 600.

The set control circuit 700 is disposed on the printed circuit board 600. The set control circuit 700 is configured to generate and output the data signals, the synchronization signals and the power source signal in order to drive the display control circuit 200.

In the display apparatus according to an exemplary embodiment, the set control circuit 700 may be a transmitter Tx which transmits the transmission signal. The display control circuit 200 may be a receiver Rx which receives the transmission signal. The printed circuit board 600, the connector 500 and the flexible circuit board 400 may be a transmission channel Ch which connects between the transmitter Tx and the receiver Rx.

The transmission signal may be decreased and distorted according to physical state of the transmission channel Ch of the display apparatus. Thus, the receiver Rx may receive the transmission signal of a signal level less than an initial level of the transmission signal generated from the transmitter Tx. In consideration of decrease and distortion of the transmission signal by the transmission channel Ch, the transmitter Tx generates and transmits the transmission signal having a maximum signal level. However, the receiver Rx is configured to receive when the signal level of the transmission signal is more than a minimum allowed level which is a receivable signal level for the receiver Rx. The maximum signal level of the transmission signal may be decreased and distorted according to physical state of the transmission channel Ch, nevertheless the decreased and distorted signal level of the transmission signal may be more than the minimum allowed level of the receiver. Thus, power consumption of the display apparatus may be increased.

According to an exemplary embodiment, the display control circuit 200 is configured to estimate an environment of the transmission channel Ch, to determine a signal level of the transmission signal optimized in the environment of the transmission channel Ch, and to control the set control circuit 200 so as to transmit an optimal signal level of the transmission signal, during an initial driving period. Thus, the transmission signal having the signal level of the transmission signal optimized in the environment of the transmission channel Ch is transmitted and received and thus, unnecessary power consumption may be prevented.

Figure 2:
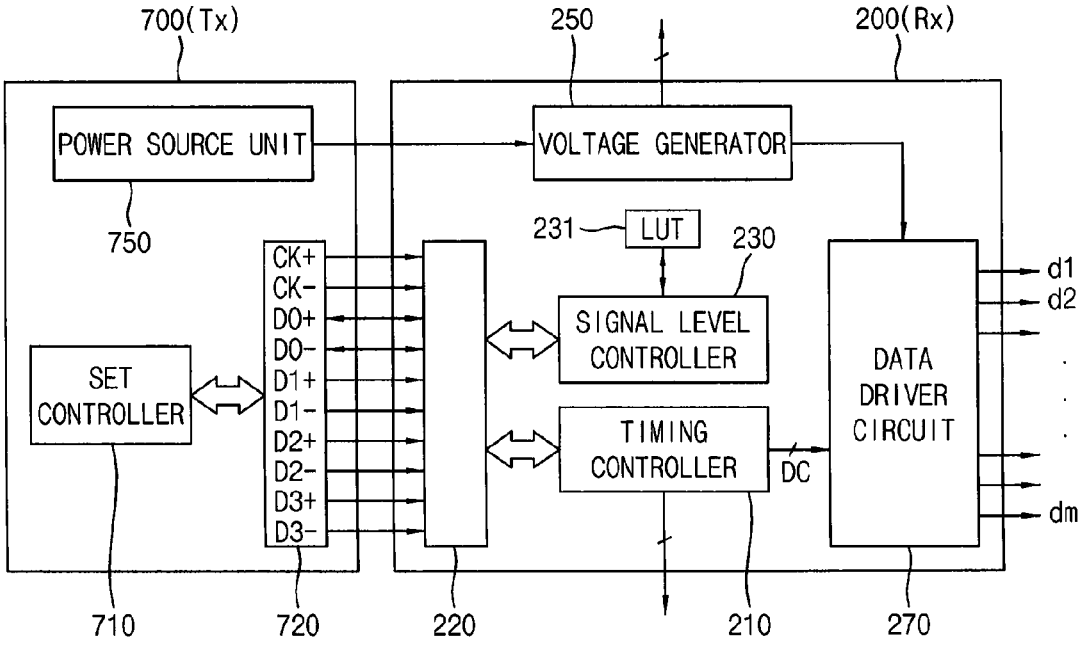
FIG. 2 is a block diagram illustrating the display apparatus of FIG. 1.
Figure 3:
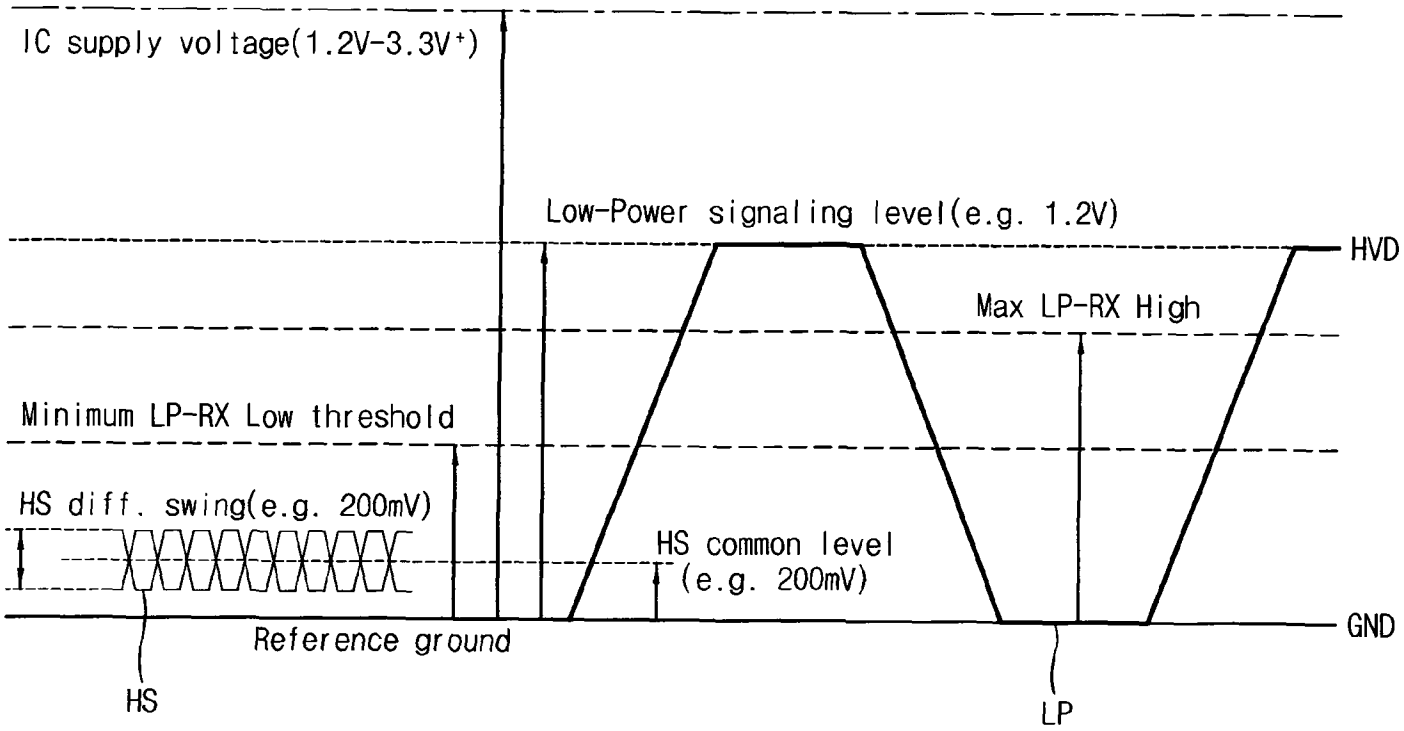
FIG. 3 is a conceptual diagram illustrating a transmission signal between the set control circuit and the display control circuit of FIG. 1.

FIG. 2 is a block diagram illustrating the display apparatus of FIG. 1. FIG. 3 is a conceptual diagram illustrating a transmission signal between the set control circuit and the display control circuit of FIG. 1.

Referring to FIGS. 1 and 2, the display control circuit 200 may include a timing controller 210, a receiving interface 220, a signal level controller 230, a look up table 231, a voltage generator 250 and a data driver circuit 270. The set control circuit 700 may include a set controller 710, a transmitting interface 720, and a power source unit 750.

The timing controller 210 is configured to generate a timing control signal for displaying an image on the display panel 100 based on the synchronization signal provided from the set control circuit 700. The timing control signal may include a data timing signal which controls a driving timing of the data driver circuit 270 and a gate timing signal which controls a driving timing of the gate driving circuit 300. The timing controller 210 is configured to correct the data signal provided from the set control circuit 700 using various compensation algorithms and to output corrected data signal to the data driver circuit 270.

The receiving interface 220 includes a clock channel which receives the synchronization signal and a data channel which receives the data signal.

The clock channel CK+ and CK− transmits a pair of clock signals. The clock channel is configured to transmit the clock signal from the set control circuit 700 as the transmitter Tx to the display control circuit 200 as the receiver Rx in one-way communication mode.

The data channel includes a plurality of data channels. Each of the data channels transmits a pair of data signals having a positive polarity (+) and a negative polarity (−). For example, the data channels may include a pair of first data channels D0+ and D0−, a pair of second data channels D1+ and D1−, a pair of third data channels D2+ and D2− and a pair of fourth data channels D3+ and D3−.

A pair of data channels is configured to transmit a pair of data signals between the set control circuit 700 as the transmitter Tx and the display control circuit 200 as the receiver Rx in two-way communication mode. Remaining data channels are configured to transmit the data signals between the set control circuit 700 as the transmitter Tx and the display control circuit 200 as the receiver Rx in one-way communication mode.

For example, in two-way communication mode, the pair of first data channels D0+ and D0− is configured to transmit a first data signal from the set control circuit 700 to the display control circuit 200, and then, is configured to transmit a command signal from the display control circuit 200 to the set control circuit 700. For example, the command signal may include an operational status signal indicating an operational status of the display control circuit 200 and a level control signal adjusting the signal level of the transmission signal according to an exemplary embodiment.

The second to fourth data channels D1+, D1−, D2+, D2−, D3+ and D3− are configured to transmit second to fourth data signals from the set control circuit 700 to the display control circuit 200 in one-way communication mode.

Referring to FIG. 3, according to a Mobile Industry Processor Interface ("MIPI") mode, the clock signal and the command signal are a low power signal LP and the data signal is a high-speed signal HS.

The low-power signal LP is a low-speed single-ended signal which has a ground signal GND and a high voltage signal HVD. The high-speed signal HS is a high-speed differential signal which has a positive polarity and a negative polarity having a phase difference of about 180 degrees from each other. The high-speed signal HS may be biased by a predetermined voltage level such as a HS common level. The HS common level may be about 200 mV.

For example, generally, the low-power signal LP and the high-speed signal HS generated from the transmitter Tx have fixed signal levels. The low-power signal LP has a fixed signal level of about 1.2V and the high-speed signal HS has a fixed signal level that is, a fixed swing level of about 200 mV.

According to an exemplary embodiment, the signal level controller 230 is configured to adjust signal levels of the low-power signal LP and the high-speed signal HS generated from the transmitter Tx according to an environment of the transmission channel Ch.

The signal level controller 230 is configured to determine the signal level of at least one of the low-power signal LP and the high-speed signal HS transmitted from the transmitter Tx into an optimal signal level corresponding to the environment of the transmission channel Ch using a plurality of offset levels stored in the look up table 231. The signal level controller 230 is configured to transmit a level control signal corresponding to an optimal signal level to the set control circuit 700. Thus, the set control circuit 700 is configured to generate at least one of the low-power signal and the high-speed signal having adjusted signal level based on the level control signal.

The look up table 231 is stored to store a plurality of low offset levels for adjusting the signal level of the low-power signal LP and a plurality of high offset levels for adjusting the signal level of the high-speed signal HS.

The voltage generator 250 is configured to generate a plurality of driving voltages which drives the display panel 100 using the power source signal transmitted from the set control circuit 200. The driving voltages may include an analog power source voltage and a digital power source voltage which are provided to the data driver circuit 270, a gate on voltage and a gate off voltage which are provided to the gate driving circuit 300 and a common voltage which is provided to the display panel 100.

The data driver circuit 270 is configured to convert a data signal provided from the timing controller 210 into a grayscale voltage of an analogue type and to output a plurality of grayscale voltages d1, d2, . . . , dm to the data lines DL of the display panel 100.

Continuously, the set control circuit 200 is explained.

The set controller 710 is configured to transmit a plurality of transmission signals which includes the data signals and the synchronization signal to the display control circuit 200 through the transmitting interface 720. The transmission signals may be divided into the low-power signal LP and the high-speed signal HS according to the MIPI mode.

The set controller 710 is configured to generate at least one of the low-power signal LP and the high-speed signal HS having the optimal signal level based on the level control signal corresponding to the environment of the transmission channel provided from the display control circuit 200. According to an exemplary embodiment, the clock signal may be the low-power signal LP and the data signal may be the high-speed signal HS.

The transmitting interface 720 is electrically connected to the receiving interface 220 of the display control circuit 200 and is configured to transmit the transmission signal outputted from the set controller 710.

The power source unit 750 is configured to provide the voltage generator 250 of the display control circuit 200 with the power source signal. The power source unit 750 may be a battery.

Figure 4:
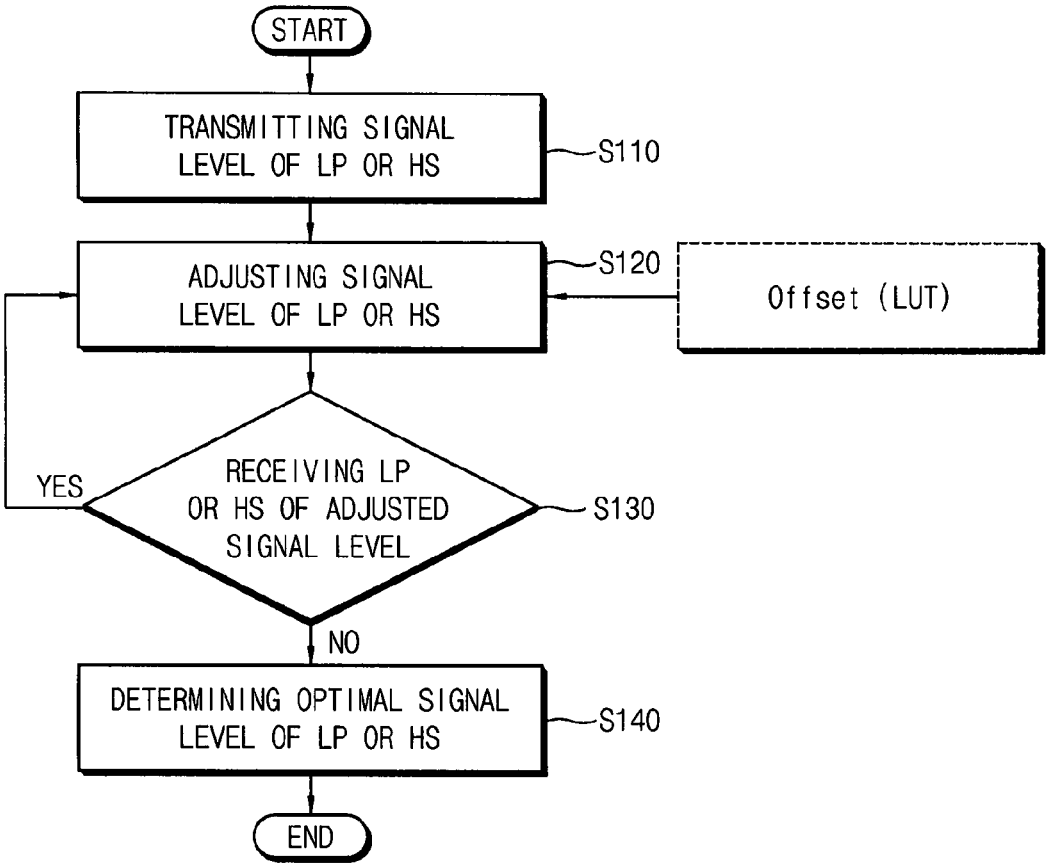
FIG. 4 is a flowchart illustrating a method of driving a display apparatus according to an exemplary embodiment.
Figure 5:
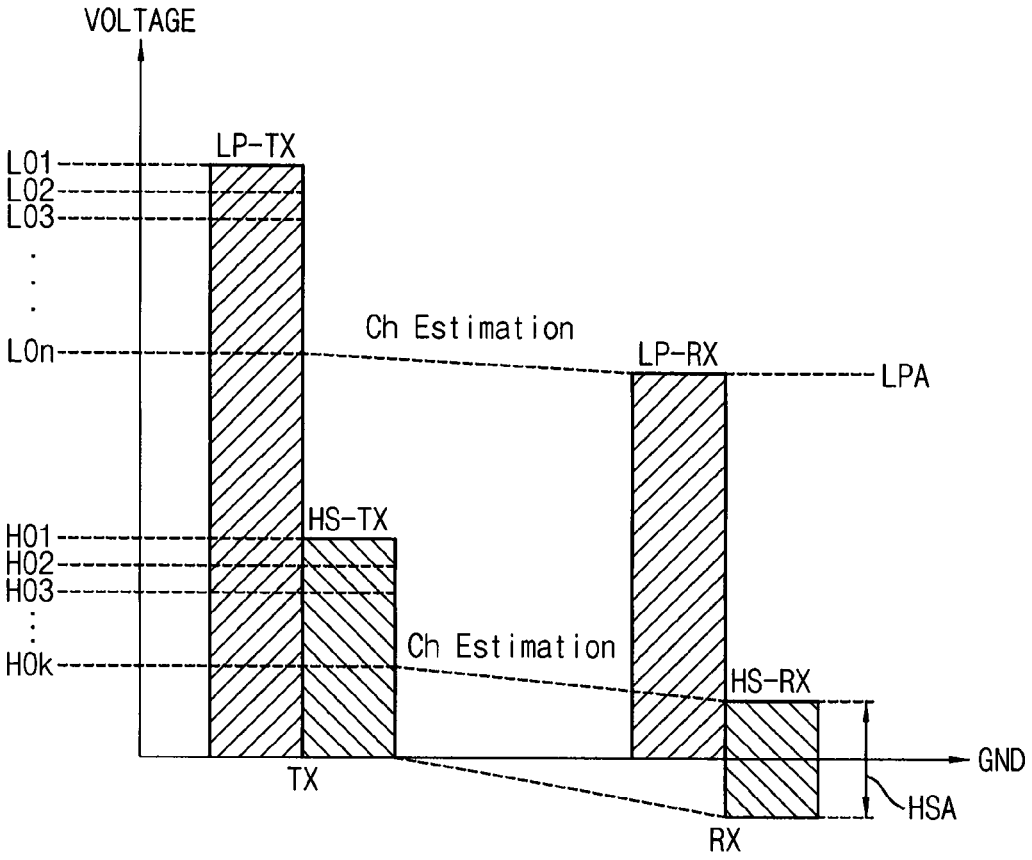
FIG. 5 is a conceptual diagram illustrating an optimal signal level of transmission data between the set control circuit and the display control circuit of FIG. 1.

FIG. 4 is a flowchart illustrating a method of driving a display apparatus according to an exemplary embodiment. FIG. 5 is a conceptual diagram illustrating an optimal signal level of transmission data between the set control circuit and the display control circuit of FIG. 1.

Referring to FIGS. 2 and 4, during an initial driving period of the display apparatus, the signal level controller 230 is configured to transmit a level control signal that is a command signal which controls the set controller 710 to transmit a clock signal being a predetermined low-power signal LP in order to adjust the signal level of the transmission signal. The set controller 710 is configured to transmit the clock signal having an initial level in response to the level control signal to the signal level adjuster 230 of the receiver Rx (Step S110).

The signal level adjuster 230 of the receiver Rx has a minimum allowed level being a receivable signal level which is predetermined in consideration of decrease and distortion of the transmission signal by the environment of the transmission channel Ch. The transmission channel includes the printed circuit board 600, the connector 500 and the flexible circuit board 400 which connect between the set control circuit 700 and the display control circuit 200 as shown in FIG. 1.

Referring to FIG. 5, when the signal level of the low-power signal LP is more than the minimum allowed level, the signal level adjuster 230 may normally receive the low-power signal LP. In addition, when the signal level (swing level) of the received high-speed signal HS is more than an allowed swing level HAS, the signal level adjuster 230 may normally receive the high-speed signal HS.

The signal level adjuster 230 is configured to detect the signal level of the clock signal that is the low-power signal LP, to select a low offset level lower than a low offset level corresponding to the initial level of the clock signal among the plurality of low offset levels LO1, LO2, . . . , LOn stored in the look up table 231 and to transmit the selected low offset level to the set controller 710 ('n' is a natural number).

Referring to FIG. 5, when the signal level of the clock signal corresponds to a first low offset level LO1, the signal level adjuster 230 selects a second low offset level LO2 lower than the first low offset level LO1 and transmits the level control signal corresponding to the second low offset level LO2 to the set controller 710. If the clock signal is received by the receiving interface 220, the signal level of the clock signal is normal.

The set controller 710 generates a clock signal having a second signal level corresponding to the second low offset level LO2 and retransmits the clock signal having the second signal level to the signal level adjuster 230. The second signal level of the clock signal is decreased by the transmission channel between the set control circuit 700 and the display control circuit 200 and the decreased clock signal is transmitted to the display control circuit 200. When the decreased clock signal by the transmission channel is normally received (Step S130), the signal level adjuster 230 selects a third low offset level LO3 lower than the second low offset level LO2 in the look up table 231 and transmits the level control signal corresponding to the third low offset level LO3 to the set controller 710. The set controller 710 generates a clock signal corresponding to the third low offset level LO3 and retransmits the clock signal corresponding to the third low offset level LO3 to the signal level adjuster 230.

As described above, the signal level adjuster 230 gradually adjusts the signal level of the clock signal using the low offset levels in the look up table 231 according to the environment of the transmission channel between the set control circuit 700 and the display control circuit 200 (Step S120).

However, when the clock signal of the third signal level corresponding to the third low offset level LO3 is not received (Step S130), the signal level adjuster 230 determines the optimal signal level of the clock signal according to the transmission channel into the second signal level. The optimal signal level of the clock signal is a receivable signal level for the display control circuit 200, and is the lowest signal level of the clock signal corresponding to and determined by one of the low offset levels LO1, LO2, . . . , LOn. Thus, the signal level adjuster 230 transmits the level control signal which controls to determine the signal level of the clock signal into the second signal level, to the set controller 710 (Step S140).

Therefore, the set control circuit 700 is configured to generate the low-power signal LP having the optimal signal level corresponding to the transmission channel and to transmit the low-power signal LP having the optimal signal level to the display control circuit 200. Thus, the signal level of the low-power signal LP may be not preset too high and thus, unnecessary power consumption may be prevented.

As described above, the signal level of the clock signal that is the low-power signal LP may be determined into the optimal signal level corresponding to the environment of the transmission channel.

Alternatively, the signal level of the data signal that is the high-speed signal HS may be determined into the optimal signal level corresponding to the environment of the transmission channel.

For example, during an initial driving period of the display apparatus, the signal level controller 230 is configured to transmit a level control signal that is a command signal which controls the set controller 710 to transmit a data signal being a predetermined high-speed signal HS in order to adjust the signal level of the transmission signal. The set controller 710 is configured to transmit the data signal having an initial level in response to the level control signal to the signal level adjuster 230 of the receiver Rx (Step S110).

The signal level adjuster 230 is configured to detect the signal level of the data signal being the high-speed signal HS, to select a high offset level lower than a high offset level corresponding to the initial level of the data signal among the plurality of high offset levels HO1, HO2, . . . , HOk stored in the look up table 231 and to transmit the selected high offset level to the set controller 710 ('k' is a natural number).

Referring to FIG. 5, when the signal level of the data signal corresponds to a first high offset level HO1, the signal level adjuster 230 selects a second high offset level HO2 lower than the first high offset level HO1 and transmits the level control signal corresponding to the second high offset level HO2 to the set controller 710. If the data signal is received by the receiving interface 220, the signal level of the data signal is normal.

The set controller 710 generates a data signal having a second signal level corresponding to the second high offset level HO2 and retransmits the data signal having the second signal level to the signal level adjuster 230. The second signal level of the data signal is decreased by the transmission channel between the set control circuit 700 and the display control circuit 200 and the decreased data signal is transmitted to the display control circuit 200. When the decreased data signal by the transmission channel is normally received (Step S130), the signal level adjuster 230 selects a third high offset level HO3 lower than the second high offset level HO2 in the look up table 231 and transmits the level control signal corresponding to the third high offset level HO3 to the set controller 710. The set controller 710 generates a data signal corresponding to third high offset level HO3 and retransmits data signal corresponding to the third high offset level HO3 to the signal level adjuster 230.

As described above, the signal level adjuster 230 gradually adjusts the signal level of the data signal using the high offset levels in the look up table 231 according to the environment of the transmission channel between the set control circuit 700 and the display control circuit 200 (Step S120).

However, when the data signal of the third signal level corresponding to the third high offset level HO3 is not received (Step S130), the signal level adjuster 230 determines the optimal signal level of the data signal according to the transmission channel into the second signal level corresponding to the second high offset level HO2. The optimal signal level of the data signal is a receivable signal level for the display control circuit 200, and is the lowest signal level of the data signal corresponding to and determined by one of the high offset levels HO1, HO2, . . . , HOk. Thus, the signal level adjuster 230 transmits the level control signal which controls to determine the signal level of the data signal into the second signal level, to the set controller 710 (Step S140).

Therefore, the set control circuit 700 is configured to generate the high-speed signal HS having the optimal signal level corresponding to the transmission channel and to transmit the low-power signal LP having the optimal signal level to the display control circuit 200. The signal level of the high-speed signal HS may be not preset too high and thus, unnecessary power consumption may be prevented.

As described above, the signal level of the clock signal that is the high-speed signal HS may be determined into the optimal signal level corresponding to the environment of the transmission channel.

Figure 6:
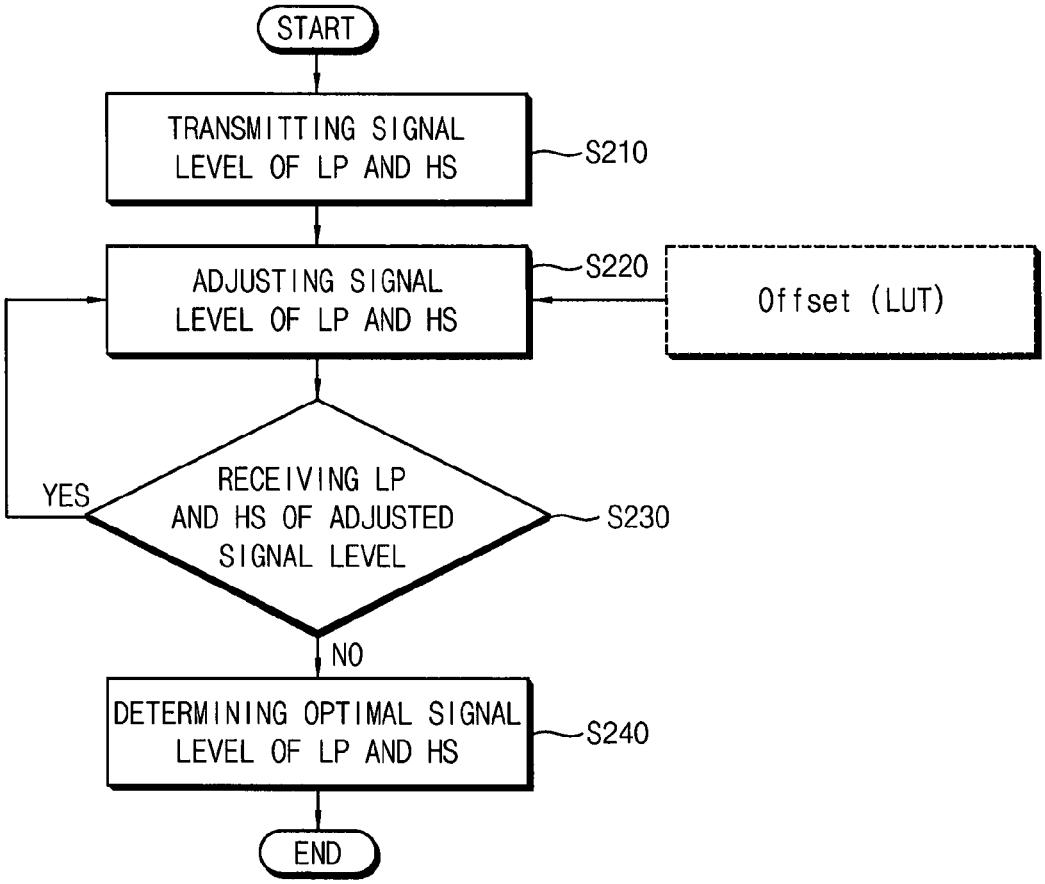
FIG. 6 is a flowchart illustrating a method of driving a display apparatus according to an exemplary embodiment.

FIG. 6 is a flowchart illustrating a method of driving a display apparatus according to an exemplary embodiment.

According to the method of driving a display apparatus, signal levels of the low-power signal LP and the high-speed signal HS are concurrently adjusted.

For example, referring to FIGS. 2 and 6, during an initial driving period of the display apparatus, the signal level controller 230 is configured to transmit a level control signal that is a command signal which controls the set controller 710 to transmit a clock signal being a predetermined low-power signal LP a data signal being a predetermined high-speed signal HS in order to adjust the signal level of the transmission signal.

The set controller 710 is configured to transmit the clock signal and the data signal respectively having an initial level in response to the level control signal to the signal level adjuster 230 of the receiver Rx (Step S210).

The signal level adjuster 230 is configured to detect the signal level of the clock signal that is the low-power signal LP, to select a low offset level lower than a low offset level corresponding to the initial level of the clock signal among the plurality of low offset levels LO1, LO2, . . . , LOn stored in the look up table 231 and to transmit the selected low offset level to the set controller 710 ('n' is a natural number). And then, the signal level adjuster 230 is configured to detect the signal level of the data signal being the high-speed signal HS, to select a high offset level lower than a high offset level corresponding to the initial level of the data signal among the plurality of high offset levels HO1, HO2, . . . , HOk stored in the look up table 231 and to transmit the selected high offset level to the set controller 710 ('k' is a natural number).

For example, when the signal level of the clock signal corresponds to a first low offset level LO1, the signal level adjuster 230 selects a second low offset level LO2 lower than the first low offset level LO1 and transmits the level control signal corresponding to the second low offset level LO2 to the set controller 710. When the signal level of the data signal corresponds to a first high offset level HO1, the signal level adjuster 230 selects a second high offset level HO2 lower than the first high offset level HO1 and transmits the level control signal corresponding to the second high offset level HO2 to the set controller 710.

The set controller 710 generates a clock signal having a second signal level corresponding to the second low offset level LO2 and a data signal having a second signal level corresponding to the second high offset level HO2 and then, retransmits the clock signal having the second signal level and the data signal having the second signal level to the signal level adjuster 230. The second signal levels of the clock signal and the data signal are decreased by the transmission channel between the set control circuit 700 and the display control circuit 200 and the decreased clock and data signals are transmitted to the display control circuit 200.

The signal level adjuster 230 determines whether the clock and data signals having the second signal level decreased by the transmission channel are normally received (Step S230).

For example, when the clock signal is normally received and the data signal not received, the signal level adjuster 230 determines the optimal signal level of the data signal according to the transmission channel into the initial level corresponding to the first high offset level HO1 (Step S240).

However, the signal level adjuster 230 selects a third low offset level LO3 lower than the second low offset level LO2 in the look up table 231 and transmits the level control signal corresponding to the third low offset level LO3 to the set controller 710. The set controller 710 generates a clock signal corresponding to the third low offset level LO3 and retransmits the clock signal corresponding to the third low offset level LO3 to the signal level adjuster 230.

When the clock signal of the third signal level corresponding to the third low offset level LO3 is not received (Step S230), the signal level adjuster 230 determines the optimal signal level of the clock signal according to the transmission channel into the second signal level. Thus, the signal level adjuster 230 transmits the level control signal which controls to determine the signal level of the clock signal into the second signal level, to the set controller 710 (Step S240).

As described above, the signal levels of the clock signal and the data signal may be determined into the optimal signal level corresponding to the environment of the transmission channel.

The signal level adjuster 230 transmits the level control signal which controls to determine the signal level of the clock signal into the second signal level and the signal level of the data signal into the initial level, to the set controller 710. And then, the set controller 710 generates and transmits the clock signal being the low-power signal LP and the data signal being the high-speed signal HS in response to the level control signal.

According to an exemplary embodiment, the set control circuit 700 is configured to generate the low-power signal LP and the high-speed signal HS having the optimal signal level corresponding to the transmission channel and to transmit the low-power signal LP and the high-speed signal HS having the optimal signal level to the display control circuit 200. Thus, the signal levels of the low-power signal LP and the high-speed signal HS may be not preset too high and thus, unnecessary power consumption may be prevented.

As described above, according to exemplary embodiments, the signal level of the transmission signal transmitted between the set control circuit and the display control circuit may be adjusted according to the channel environment of the transmission channel physically connecting the set control circuit and the display control circuit and thus, unnecessary level margin of the transmission signal may be decreased. Therefore, power consumption of the display apparatus may be decreased.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus, comprising:

a set control circuit configured to generate a plurality of transmission signals and transmitting the transmission signals through a transmitting interface;

a display control circuit configured to receive the transmission signals through a receiving interface and to drive a display panel based on the transmission signals; and a transmission channel directly physically connecting the transmitting interface and the receiving interface, and configured to transfer the transmission signals, the display control circuit configured to transmit and receive a transmission signal with the set control circuit through the transmission channel, and to control the set control circuit to determine a signal level of the transmission signal and adaptively adjust the signal level of the transmission signal according to a channel environment solely of the transmission channel between the set control circuit and the display control circuit into an optimal signal level being a receivable signal level for the display control circuit that reduces power consumption.

2. The display apparatus of claim 1, wherein the display control circuit comprises a look up table which comprises a plurality of offset levels for adjusting the signal level of the transmission signal.

3. The display apparatus of claim 2, wherein the transmission signals comprise a low-power signal and a high-speed signal.

4. The display apparatus of claim 3, wherein the look up table comprises a plurality of low offset levels corresponding the low-power signal and a plurality of high offset levels corresponding to the high-speed signal.

5. The display apparatus of claim 3, wherein the low-power signal comprises a clock signal and a command signal, and the high-speed signal comprises a data signal.

6. The display apparatus of claim 3, wherein the display control circuit is configured to adjust a signal level of at least one of the low-power signal and the high-speed signal.

7. The display apparatus of claim 3, wherein the transmitting and receiving interfaces comprises a Mobile Industry Processor Interface ("MIPI") mode.

8. The display apparatus of claim 2, wherein the display control circuit is configured to gradually adjust the signal level of the transmission signal using the offset levels according to whether the transmission signal transmitted from the set control circuit is normal, during an initial driving period.

9. The display apparatus of claim 1, wherein the transmission channel comprises a printed circuit board on which the set control circuit is disposed, a flexible circuit board is connected to the display control circuit and a connector connecting the printed circuit board and the flexible circuit board.

10. The display apparatus of claim 9, wherein the display control circuit is disposed in a peripheral area of the display panel, and comprises a timing controller configured to control a driving timing of the display panel and a data driver circuit configured to drive a data line of the display panel.

11. The display apparatus of claim 10, wherein the set control circuit comprises a battery.

12. A method of driving a display apparatus comprising:

transmitting a plurality of transmission signals through a transmitting interface of a set control circuit;

receiving the transmission signals through a receiving interface of a display control circuit;

driving a display panel based on received transmission signals; and transmitting and receiving a transmission signal through a transmission channel to determine a signal level of the transmission signal and adaptively adjusting the signal level of the transmission signal according to a channel environment solely of the transmission channel between the set control circuit and the display control circuit into an optimal signal level being a receivable signal level for the display control circuit, during an initial driving period that reduces power consumption.

13. The method of claim 12, further comprising:

adjusting the signal level of the transmission signal using a plurality of offset levels in stored a look up table.

14. The method of claim 13, wherein the plurality of transmission signals comprises a low-power signal and a high-speed signal.

15. The method of claim 14, wherein the look up table comprises a plurality of low offset levels corresponding to the low-power signal and a plurality of high offset levels corresponding to the high-speed signal.

16. The method of claim 14, wherein a signal level of one of the low-power signal and the high-speed signal is adjusted using the look up table.

17. The method of claim 14, wherein the transmitting and receiving interfaces comprises a Mobile Industry Processor Interface mode.

18. The method of claim 13, wherein the signal level of the transmission signal is gradually adjusted using the plurality of offset levels according to whether the transmission signal received from the set control circuit is normal during an initial driving period.

19. The method of claim 18, further comprising:

transmitting the transmission signal of the optimal signal level to the display control circuit for driving a display panel.

* * * * *